US006698126B2

(12) United States Patent
Worley

(10) Patent No.: US 6,698,126 B2
(45) Date of Patent: Mar. 2, 2004

(54) SAFETY BULLET

(75) Inventor: F. Michael Worley, c/o Lydia Newell, 1008 Frances, Pasadena, TX (US) 77506

(73) Assignee: F. Michael Worley, Panama City, FL (US)

( * ) Notice: Subject to any disclaimer, the term of this patent is extended or adjusted under 35 U.S.C. 154(b) by 0 days.

(21) Appl. No.: 10/155,964

(22) Filed: May 30, 2002

(65) Prior Publication Data

US 2002/0178636 A1 Dec. 5, 2002

Related U.S. Application Data

(60) Provisional application No. 60/295,568, filed on Jun. 5, 2001.

(51) Int. Cl.[7] ..... F41A 17/00
(52) U.S. Cl. ..... 42/70.11
(58) Field of Search ..... 42/70.11, 96; 102/439

(56) References Cited

U.S. PATENT DOCUMENTS

| | | | | | |
|---|---|---|---|---|---|
| 2,405,308 | A | * | 8/1946 | Jack | 434/19 |
| 3,027,674 | A | * | 4/1962 | Mahan | 42/66 |
| 3,208,176 | A | | 9/1965 | Giles | 42/66 |
| 3,249,048 | A | | 5/1966 | Kerr | 102/447 |
| 3,360,880 | A | | 1/1968 | Finnegan | 42/66 |
| 3,848,350 | A | * | 11/1974 | Seminiano | 42/96 |
| 4,100,693 | A | * | 7/1978 | Cech | 42/96 |
| 4,147,107 | A | * | 4/1979 | Ringdal | 102/467 |
| 4,224,753 | A | | 9/1980 | Bielman | 42/70.11 |
| 4,233,902 | A | * | 11/1980 | Hartley et al. | 102/444 |
| 4,486,966 | A | * | 12/1984 | Seehase | 42/1.01 |
| 4,546,704 | A | * | 10/1985 | Ballreich et al. | 102/444 |
| 5,010,674 | A | | 4/1991 | Horton | 42/70.11 |
| 5,014,457 | A | | 5/1991 | Lewis | 42/70.11 |
| 5,138,785 | A | * | 8/1992 | Paterson | 42/66 |
| 5,291,832 | A | * | 3/1994 | Plummer | 102/444 |
| D349,323 | S | * | 8/1994 | Howard | D22/108 |
| 5,347,739 | A | | 9/1994 | Stuart | 42/70.11 |
| 5,394,635 | A | * | 3/1995 | Stuart | 42/70.11 |
| 6,170,186 | B1 | * | 1/2001 | Reed | 42/70.11 |

* cited by examiner

*Primary Examiner*—Michael J. Carone
*Assistant Examiner*—D Buckley
(74) *Attorney, Agent, or Firm*—F. Michael Worley

(57) ABSTRACT

A firearm safety bullet that locks into place rendering the gun inoperable. When fired the propellant forces a ram into an internal captive plastic sleeve. The shaft of the ram which has a tapered end, pushes its way through the center of a captive plastic sleeve expanding it with a pneumatic force causing the plastic sleeve to be pushed hard against the inside of the firearm and locking the shell inside the firing chamber. This will do several things all at one time, it will lock the shell inside the gun rendering it unusable, it will prevent a live shell from being introduced and it will stop anyone from using the firearm that is not aware that a safety bullet has been placed in the gun. It will save lives and prevent injury from accidental shootings.

6 Claims, 4 Drawing Sheets figure # 7

SAFETY BULLET

CROSS REFERENCE TO RELATED APPLICATIONS

This application is entitled to the benefit of the Provisional Patent Application Ser No. 60/295,568 dated Jun. 5, 2001 This information relates to Firearm Safety Devices, specifically an improved device for stopping accidental discharging of any firearm.

BACKGROUND

BRIEF SUMMARY OF THE INVENTION

My "Safety Bullet" is designed to be placed in the firing chamber or in a firing position of any gun for the express purpose of keeping anyone that is not aware of its presence from using the firearm. When fired it will lock the firearm up and make it impossible to place a live round in the firing chamber. This will protect the owner and anyone else in the immediate area from harm. In addition it also makes the gun far faster to use than any gun lock by simply ejecting the "Safety Bullet" the firearm will be ready to be used by its owner.

DETAILED DESCRIPTION

The "Safety Bullet" is made of four major components, the shell casing, propellant, metal ram and an expander. When all components are assembled and placed inside the firing chamber of any gun you will have a device unseen and its presence only known by the owner of the firearm. In order to understand how the "Safety Bullet" works you first need to understand as to how it is made and then what happens when it is fired. The shell casing is the same shell casing that each gun would normally use. The propellant charge would have to be calculated for each firearm to make it as effective and balanced as possible. The controlled explosion has to be strong enough to make all the components work yet not so strong as to destroy the safety bullet. The propellant would be pressed inside the "Safety Bullet".

The Metal Ram would have to be sized for each caliber and type of gun, automatic or revolver. The Metal Ram would be similar in shape to a roofing nail with its flattened end up against the propellant and the tapered pointed end would rest inside the Expander. The shaft of the Ram is the determining factor as to how much pressure is exerted against the Expander. The larger the shaft, the harder it would press. When fired the metal ram can only travel to the captive end of the Expander. The shaft will move forward and through the pilot hole that has been drilled or formed in the front of the Expander. The pilot hold is one tenth the size of the shaft of the Ram. This is to enable the shaft to push outward the Expander and lock the "Safety Bullet" in the firearms chamber. For auto automatics the Metal Plunger only need to lock the Safety Bullet in place. With the revolver the Metal Ram has to not only lock the Safety Bullet in place it has to travel far enough to go into the barrel of firearm to keep the cylinder from revolving and aligning a new and lethal round into position. The Metal Ram is placed inside the shell casing against the Propellant Charge and inside the Expander.

Then the Plastic Expander is placed inside the shell casing allowing for the Metal Ram to be placed directly in its center in its firing position. The Expander can be made of a hard plastic or metal depending on how permanent the owner of the firearm and how strong a bond is required between the "Safety Bullet" and the firearm. The Expander is held in place inside the shell casing by either a groove or dimples pressed in the shell casing just forward of the inside end of the expander. This is to lock the Expander and Ram inside the shell casing. Without this feature, when fired the ram and expander could be pro propelled down the barrel of the gun. The Expander can either be made by Injection Molding, machined or milled to its proper shape. The inside end of the expander is flattened and is of the same inside diameter of the shell casing then the body of the expander is shaped to allow one half the space as the diameter of the shaft of the metal ram. This is to allow for the expansion of the Expander when the ram is fired through the Expander and into the pilot hole. When the Ram reaches the pilot hole of the Expander the tapered end of the Ram is forced through the pilot hole and causes the outside end of the Expander to expand and push up hard against the inside of the firearms chamber, locking the "Safety Bullet" in place. The outboard end of the Expander is of the same diameter as the outside of the shell casing. This is to allow it to be readily placed in the firearms chamber and yet not have to far of a distance to travel when the "Safety Bullet" is fired. In a revolver the same actions would take place but the Ram would be configured to move forward far enough to move into the barrel of the firearm, so that a new lethal bullet could not move or revolve, into place.

If a permanent locking of the gun is desired the Expander can be made of metal and the ram shortened to not go beyond the end of the Expander thereby permanently locking the "Safety Bullet" in place. The only way of removing it would be to drill it out. The removal of the "Safety Bullet" is done by inserting a rod of sufficient length and size for each caliber of gun to push the Ram back into the end of the "Safety Bullet" and releasing the pressure on the Expander. Until this is done the "Safety Bullet" will remain locked inside the firearm.

I designed the "Safety Bullet" mainly for children. To stop kids from killing each other. Also for those that need a firearm for their own safety. With the "Safety Bullet" in place, if the gun is needed, immediately, the owner only needs to eject the "Safety Bullet" and the gun is ready for use. As opposed to a gun lock or a safe in which case by the time the gun could be made ready to be used the owner may be shot, raped or even killed. My "Safety Bullet" will save countless lives.

A=PRIMER
B=SHELL CASING
C=RAM
D=GROOVE
F=FIRING CHAMBER
E=EXPANDER
G=PILOT HOLE

DETAILED DESCRIPTION OF DRAWINGS

Figure 1:
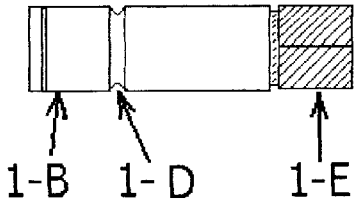
FIG. 1, Shows the assembled "Safety Bullet"

FIG. 1 A side on view, shows the completed, assembled, "Safety Bullet". The shell casing (B) is visible as a single black line. Around its circumference, has been pressed a groove (D), this groove is to hold into place the plastic Expander (E) that the metal Ram will move through causing the Expander (E) to be forced apart and pushed hard up against the inside of the firearm locking the firearm. The exterior portion of the Expander (E) is of the same exterior dimension of the shell casing. This is to enable it to be forced outward and against the inside of the firearms firing chamber. The horizontal line that appears on the side on the Expander (E) is a cut that has been made so that when the Metal Ram (C) is fired the Expander (E) will separate into four or more pieces and be forced against the walls of the firing chamber.

Figure 2:
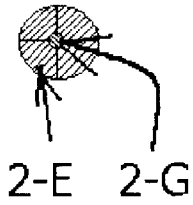
FIG. 2. Shows the plastic expandable end (E) of the "Safety Bullet" a front on view and pilot hole (G).

FIG. 2 a frontal view of the "Safety Bullet" shows the Expander (E) as it should appear, cut into four sections and a small pilot hole (G) drilled for the Metal Ram (C) to be guided through when the "Safety Bullet" is fired.

Figure 3:
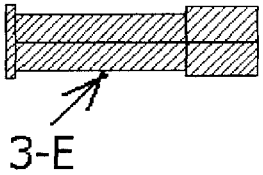
FIG. 3. Shows the Expandable sleeve (E) or Expander that is inserted in the "Safety Bullet" than locked into place by the groove pressed into the shell casing.

FIG. 3 is of the Expander (C). The captive end of the expander, is the same diameter as the inside of the shell casing (B) is flattened keep it from leaving the shell casing and it is held in place by the groove (D) pressed into the shell casing. The line down the middle of the Expander (E) is the cut that has been made to allow for expansion when the shell has been activated. The body of the insert is smaller than the inside diameter of the shell casing to allow for expansion and the outside end of the insert is of the same diameter of the outside of the shell casing to allow for insertion in the firing chamber of the firearm and to give the "Safety Bullet" the maximum advantage for lodging inside the chamber when fired.

Figure 4:
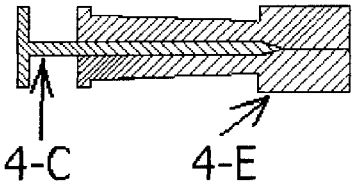
FIG. 4. A Cutaway of the Metal Ram (C) and the Expander (E) that has been fitted with the Metal Ram.

FIG. 4 A cutaway with the Metal Ram (C) inserted in the c Expander (E), it is in its firing position and at this point would be placed inside the shell casing (B). The Metal Ram (C) would rest up against the primer charge (A). Once inserted in the shell casing the groove (D) would be pressed into the shell casing just forward of the end of the Expander (E) which would lock the Expander (E) into the shell casing (B). This would keep all the component parts locked into the shell casing (B) and that would keep the "Safety Bullet" locked into the firearms firing chamber and locked into the firearm when fired. The Expander (E) would have two separate holes (G) drilled into its length down the center line for the Metal Ram (C) One hole would be the size of the diameter of the Ram (C) that would allow for it to be placed into the heart of the Expander (E) This hole would be drilled from the captive end of the Expander (E) to just inside the end of the shell casing (B). The second hole which would be drilled in the visible end of the Expander (E) would be a pilot hole (G) that would be one tenth the diameter of the tapered end of the Metal Ram (E). So that when the "Safety Bullet" is fired the tapered end of the Metal Ram (C)l be pushed through the smaller hole forcing it away from the center and hard against the inside of the firearm.

Figure 5:
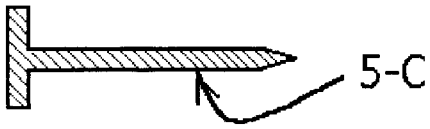
FIG. 5 A side profile of the Metal Ram (C), which is the means to which the Expander will be pushed apart and locks the "Safety Bullet" in the firing chamber.

FIG. 5 The Metal Ram (C) is in the form of a large tack. Made with enough metal to not be torn apart by the force of the gas and the pressure placed on it when the "Safety Bullet" is fired. The length and diameter of each Metal Ram (C) would have to be calculated for each caliber bullet. The end of the Metal Ram (C) that rests against the Propellant (A) is of the same circumference of the inside diameter of the shell casing (B) while the opposite end is tapered to allow it to be guided through the Expander's (E) pilot hole (G) and allow the larger diameter of the rod to push through the Expander (E) and push the end of the "Safety Bullet" up hard against the inside of the shell casing (B).

Figure 6:
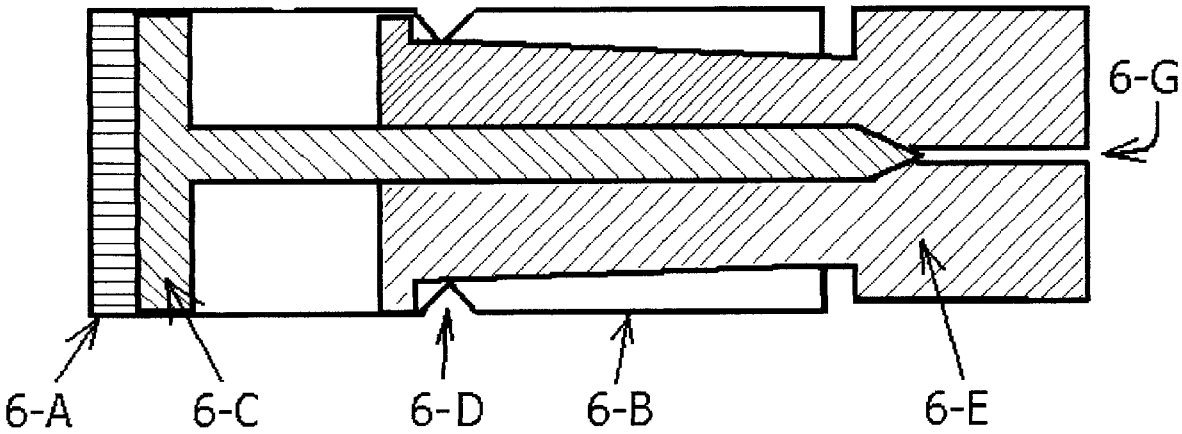
FIG. 6 A cutaway showing the interior and shell casing (B) of the "Safety Bullet" in its ready to be fired position.

FIG. 6 A cutaway of the finished "Safety Bullet" show the shell casing (B) with the groove (D) pressed in the side of the shell casing as a V that would extend around the entire circumference of the shell casing (B). The propellant (A) is in the firing end of the "Safety Bullet" with the Metal Ram (C) up against it. Forward of the inboard end of the Metal Ram (C) is a space for the Metal Ram (C) to travel when the "Safety Bullet" is fired to allow it to be pushed to its resting place against the inboard end of the Plastic Expander (E). In doing so the tapered end has been pushed through the Expander (E) and has forced the Expander (E) up against the inside of the firearm. The body of the Expander (E) is of a smaller diameter than the inside of the shell casing (B) so that when the "Safety Bullet" is fired it will have room to expand. Without this space, most of the effectiveness of the "Safety Bullet" would be lost.

Figure 7:
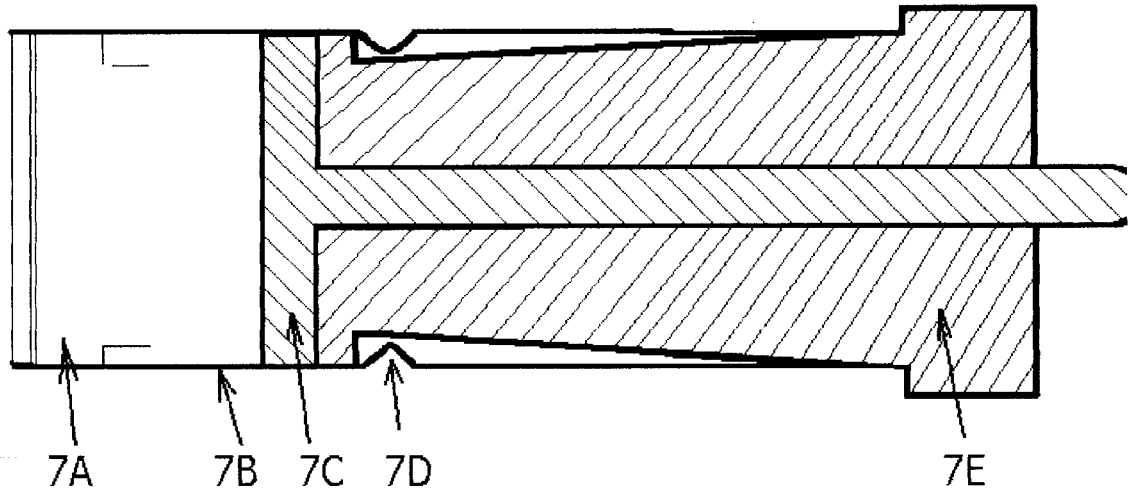
FIG. 7 A cutaway of the "Safety Bullet" after firing, showing the Metal Ram (C) as being forced through the Expander (E) and pushing it hard up against the inside of the chamber of the gun. It also shows that the primer (A) has been ignited causing this action.
Figure 8:
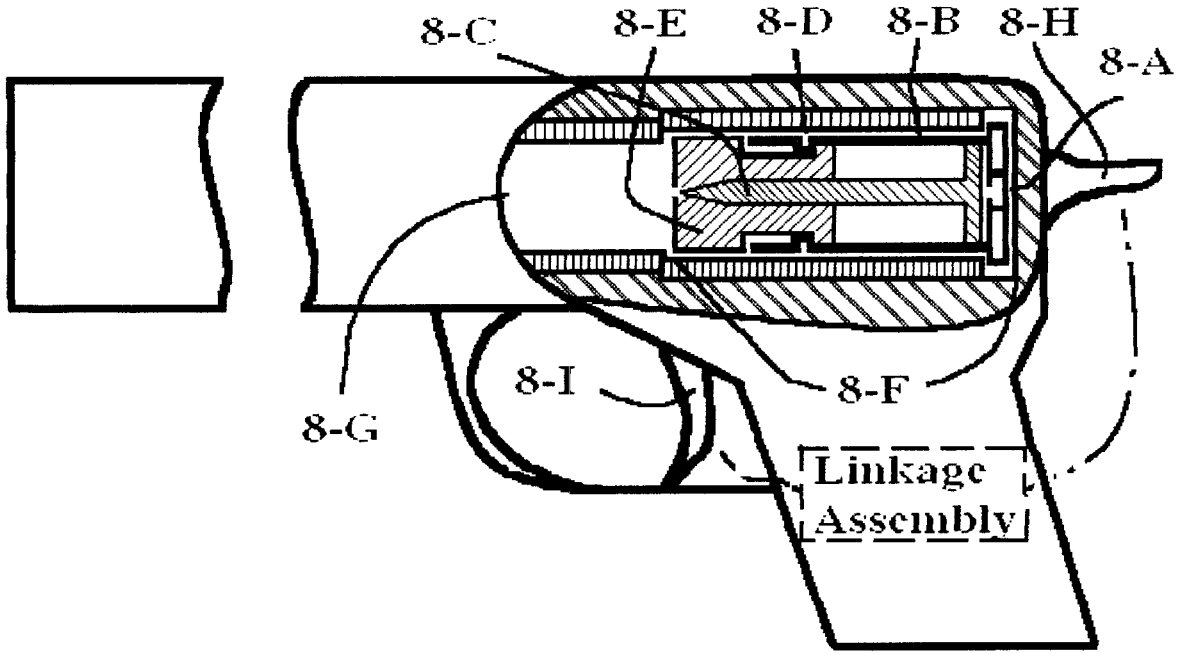
FIG. 8 A cutaway of the "Safety Bullet" sitting in the firing chamber of a handgun in its prefire position. The ram (C) is sitting in side the shell casing (B) and inside the expander (E). It is ready to be fired.
Figure 9:
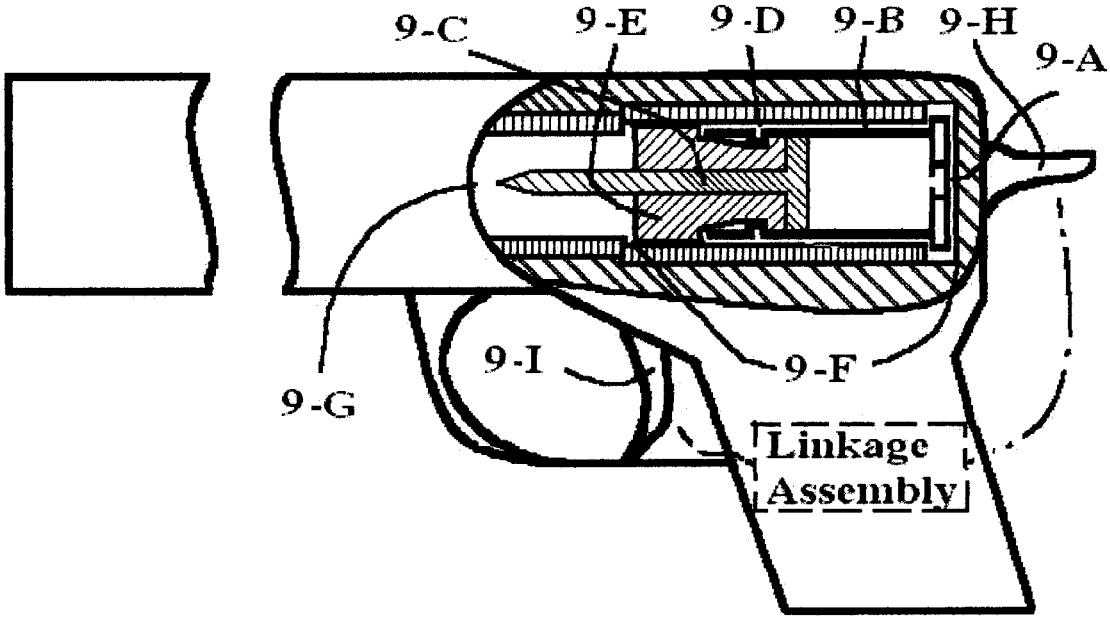
FIG. 9 A cutaway of the "Safety Bullet" sitting inside the firing chamber of a handgun after it has been fired. The Ram (C) has been pushed by the primer charge (A) and has been propelled up to the groove (D) and through the end of the expander (E) where it has pushed the expander outward and against the firing chamber (F) effectively disableing the firearm and rendering it inoperable. The Ram (C) has also traveled into the barrel of the firearm which will stop the cylinder of a revolver from revolving. It effectively disables both types of handguns.

FIG. 7 cutaway of the "Safety Bullet" after firing showing that the Propellant charge (A) is gone and the Metal Ram (C) has been forced up through the end of the Expander (E). The Expander (E) has been forced apart by the Metal Ram (C) and is now locked into the inside of the firearm. The Metal Ram (C) is hard against the Expander (E) End which is held in place by the groove (D) that was pressed in the shell and the outboard end of the Ram (C) has proceeded beyond the Expander (E) and into the barrel of the firearm. If the Ram (C) was shortened so that it did not proceed beyond the end of the Expander (E) the only way to remove the "Safety Bullet" would be to drill it out. For those applications where a permanent solution would be required the "Safety Bullet" could be configured for that application if anyone so desired it.

Having described my invention in such terms as to enable those of skill in the art to understand and practice it, having identified the presently preferred embodiments thereof I claim:

1. A safety bullet for a firearm where said firearm includes a barrel having a breech end, firing chamber, and a firing mechanism, the safety bullet comprising:

a shell casing shaped and dimensioned to be inserted in the firing chamber of the firearm, a propellant mounted in said shell casing ignited by the firing mechanism to form gas in said shell casing, a segmented captive sleeve expander having a first end within the casing and held in place by an annular protuberance formed in said shell casing, and a second exposed end outside the casing, a metal ram having an enlarged portion in the form of a projectile, mounted and shaped to be propelled inside said shell casing and inside said expander until said ram reaches and stops at the first end of said expander, and wherein said ram travels beyond the second exposed end of said expander causing said expander to push outwardly apart in sections towards the chamber walls of the firearm with the force to lock the safety bullet into place.

2. A safety cartridge for a firearm having a barrel with a breech end, a firing chamber and a firing mechanism, the safety cartridge including:

a shell case being shaped and dimensioned to be inserted into the firing chamber of the firearm, a captive plastic expandable sleeve located inside said shell case, a propellant mounted in said shell case to be activated by said firing mechanism, a projectile housed inside said sleeve having a flattened end and a shaft tapered end, wherein activation of said propellant propels said tapered end of the projectile towards the breech end of the barrel forcing apart said sleeve and wedging said sleeve against the inside of the firearm locking the safety bullet into place.

3. Safety bullet as defined in claim 1, wherein the safety bullet can work with any firearm and configured to lock the safety bullet in place with a pound per square inch or up to several thousands pounds per square inch by increasing the diameter of the said ram and changing the size of the propellant.

4. Safety bullet as defined in claim 1, wherein the removal of the safety bullet after firing can be accomplished by inserting a rod in the barrel of the firearm and pushing said ram back into its prefired position thereby releasing pressure on said expander.

5. Safety bullet as defined in claim 1, whereby when the gun is accidentally discharged the firing mechanism will be protected and dry firing will do no harm.

6. Safety bullet as defined in claim 1, wherein said expander is made of metal fortifying a permanent lock in the firearm, and a shorten the ram will stop travel of said ram beyond the end of the expander, thereby removal of said safety bullet is only achieved by drilling said safety bullet out.

* * * * *